US006298819B1

(12) United States Patent
Johnson et al.

(10) Patent No.: US 6,298,819 B1
(45) Date of Patent: Oct. 9, 2001

(54) AIR CLEANER ASSEMBLY ATTACHMENT FOR RADIATOR SUCTION FAN AND METHOD OF CONSTRUCTING AND OPERATING THE ASSEMBLY

(75) Inventors: Thomas L. Johnson; Lawerence O. Rescoe, both of Weidman, MI (US)

(73) Assignee: LOR Technologies, Inc., Weidman, MI (US)

( * ) Notice: Subject to any disclaimer, the term of this patent is extended or adjusted under 35 U.S.C. 154(b) by 0 days.

(21) Appl. No.: 09/686,185

(22) Filed: Oct. 11, 2000

(51) Int. Cl.[7] ..... F02B 77/00

(52) U.S. Cl. ..... 123/198 E; 55/385.1; 55/408; 55/467.1

(58) Field of Search ..... 123/198 E; 55/385.1, 55/408, 467.1

(56) References Cited

U.S. PATENT DOCUMENTS

| | | |
|---|---|---|
| 4,299,603 | 11/1981 | Friesen . |
| 4,874,411 | 10/1989 | Snauwaert et al. . |
| 5,046,458 | 9/1991 | Kronich . |
| 5,449,391 | 9/1995 | Decker . |
| 5,494,006 | 2/1996 | Davis, Jr. . |
| 5,505,756 | 4/1996 | Decker . |
| 5,766,315 | 6/1998 | Moredock . |
| 5,944,603 | 8/1999 | Guinn et al. . |

*Primary Examiner*—Noah P. Kamen
(74) *Attorney, Agent, or Firm*—Reising, Ethington, Barnes, Kisselle, Learman & McCulloch, P.C.

(57) ABSTRACT

An air cooled internal combustion engine has the usual intake radiator housing in front of its suction fan. A generally frustoconical body is mounted for rotation in front of the radiator. The body is made up of radially extending deflector fins extending outwardly in convergent relationship and spaced uniformly peripherally apart to provide elongate air entrance slits between them. Mechanism drives the body in rotation at a speed to deflect particles seeking to enter the slits without materially decreasing the rate of air flow created by the suction fan.

20 Claims, 6 Drawing Sheets

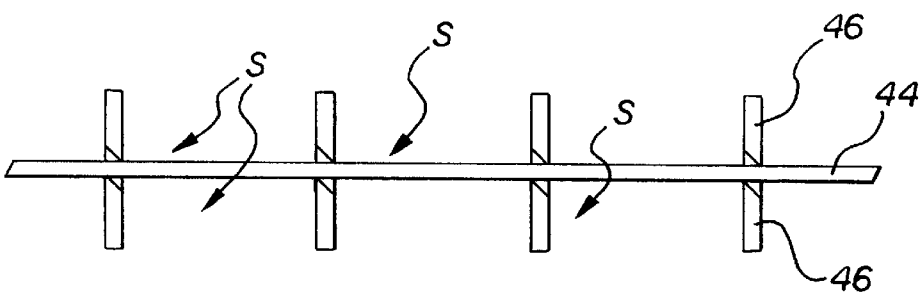
FIG-6
FIG-5
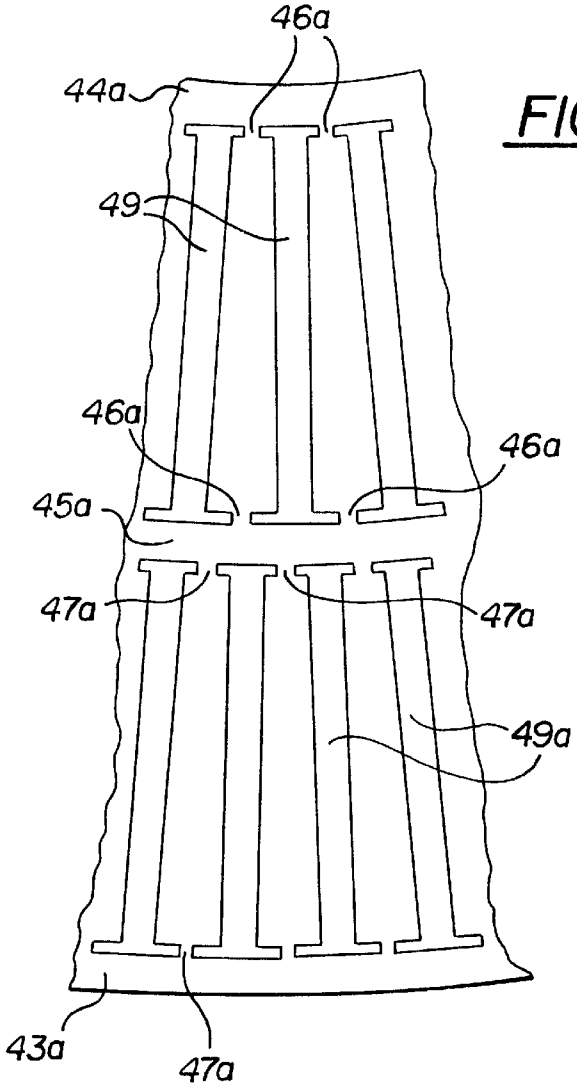

R
19
18
24
21
51
25
50
29
29a
35
53
54
S
53
43
33a
33
22
37
34
36
38
23
23a
30
52
30a 54
53
S

AIR CLEANER ASSEMBLY ATTACHMENT FOR RADIATOR SUCTION FAN AND METHOD OF CONSTRUCTING AND OPERATING THE ASSEMBLY

This application claims the priority of provisional application Ser. No. 60/158,982 filed Oct. 12, 1999. It relates to air cleaner radiator suction fan assemblies which rotate in advance of the radiator and the suction fan behind it to prevent bark particles, dirt particles, sawdust, needles, and other foreign material, which can become entrained in an air stream, from entering the radiator. The invention is particularly useful in atmospheres wherein the particles or material principally include particles of the type mentioned.

BACKGROUND OF THE INVENTION

When engine radiators become clogged with debris, the radiator becomes inoperative or, partly so, to the extent that the engine overheats. In the past, stationary mesh screens have been used in advance of the radiator when an engine is being used to power a machine at a worksite in which "dirty air" might create problems, but these screens have tended to clog and require frequent cleaning, particularly in operations in which entraining matter is created at the worksite.

Other attempts to solve the problem have involved the use of spinning perforated or mesh cylinders to admit air to radiators of the type which typically are used on agricultural machinery. These, also, tend to become easily clogged and to require frequent and difficult manual cleaning of the cylinders and radiator.

SUMMARY OF THE INVENTION

The present invention is concerned with a frustro-conical tubular device having truly radial fins which do not operate as fans to suck air, and accordingly entrained particles, into the device. The air cleaner of the present invention is in the form of a right circular cone frustrum having a slitted surface area. The frustro-conical member may be driven by its own hydraulic, or other suitable, motor at a speed different than the speed of rotation of the suction fan. The frusto-conical member is driven at a speed such as not to materially reduce the volume of air being drawn in through the frustro-conical member by the suction fan.

One of the prime objects of the present invention is to provide an air cleaner assembly which can be readily attached to the radiator frame of a radiator having a suction fan disposed behind it which is driven by the diesel or other internal combustion engine which the radiator protects.

A further object of the invention is to provide an air cleaner radiator fan assembly wherein the controlled air flow volume into the radiator is not diminished, but foreign matter which might entrain in the air flow is deflected and does not enter the air cleaner.

Another object of the invention is to provide a cleaner assembly which avoids clog problems and the frequent radiator dismantlement and cleaning associated therewith.

Still, another object of the invention is to provide an air cleaner attachment for engine radiator suction fans which is designed to prevent undue shutdown of the machinery which the engine is operating.

A further object of the invention is to provide a relatively economical assembly of the character mentioned which can be relatively economically fabricated, and yet is reliable and durable, and requires virtually no maintenance.

Other objects and advantages of the invention will become apparent with reference to the accompanying drawings and the accompanying descriptive matter.

GENERAL DESCRIPTION OF THE DRAWINGS

The presently preferred embodiment of the invention is disclosed in the following description and in the accompanying drawings, wherein:

FIG. 5 is an enlarged fragmentary view, of a portion thereof;

FIG. 6 is an enlarged fragmentary elevational view illustrating particularly the manner in which the fins formed extend marginally along the slots punched in the strip;

DETAILED DESCRIPTION

Figure 1:
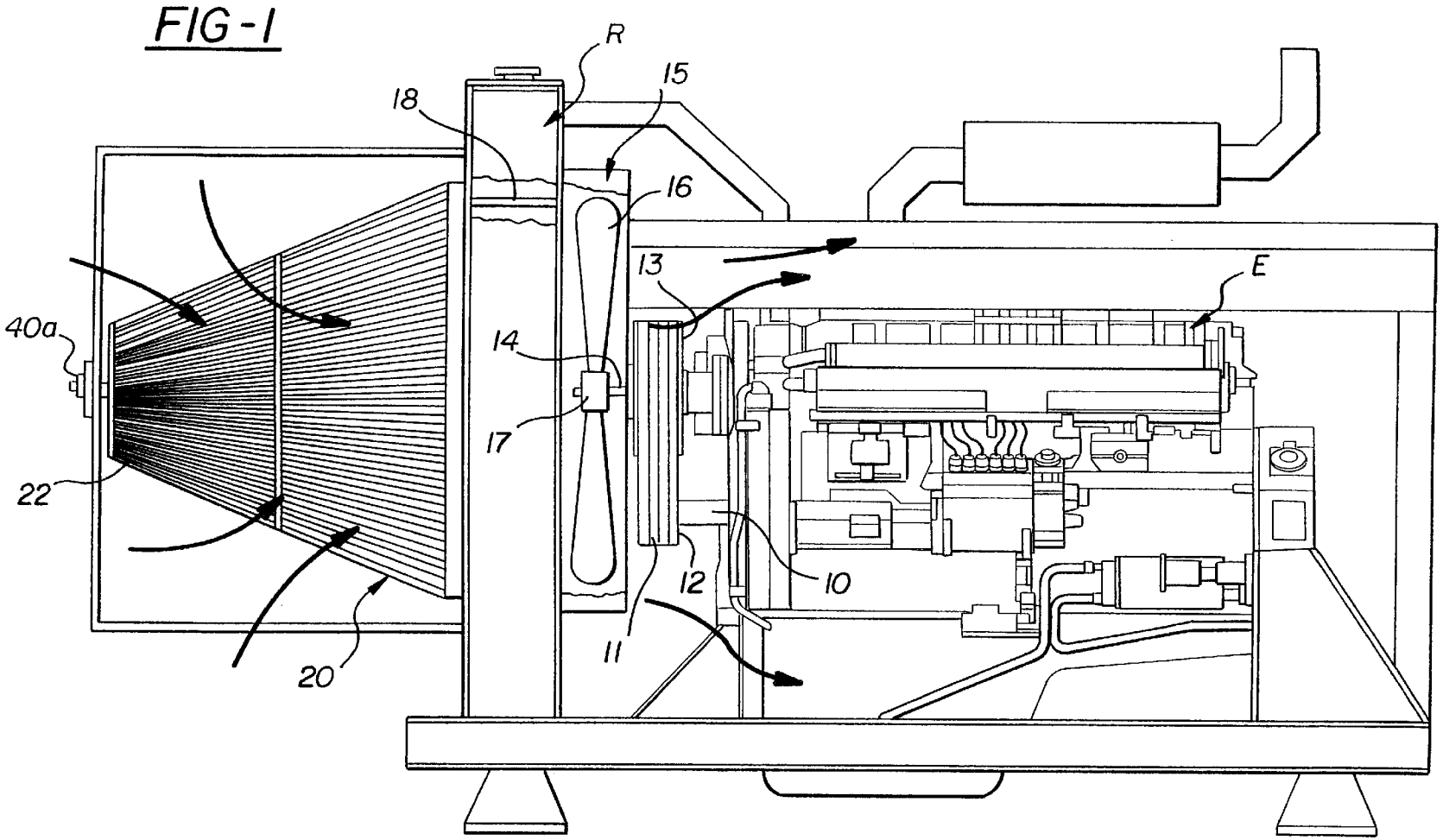
FIG. 1 is a schematic side elevational view of the engine, suction fan, engine radiator and air cleaner assembly, with portions of the suction fan and radiator housings broken away to show the fan blades and radiator fins respectively.
Figure 2:
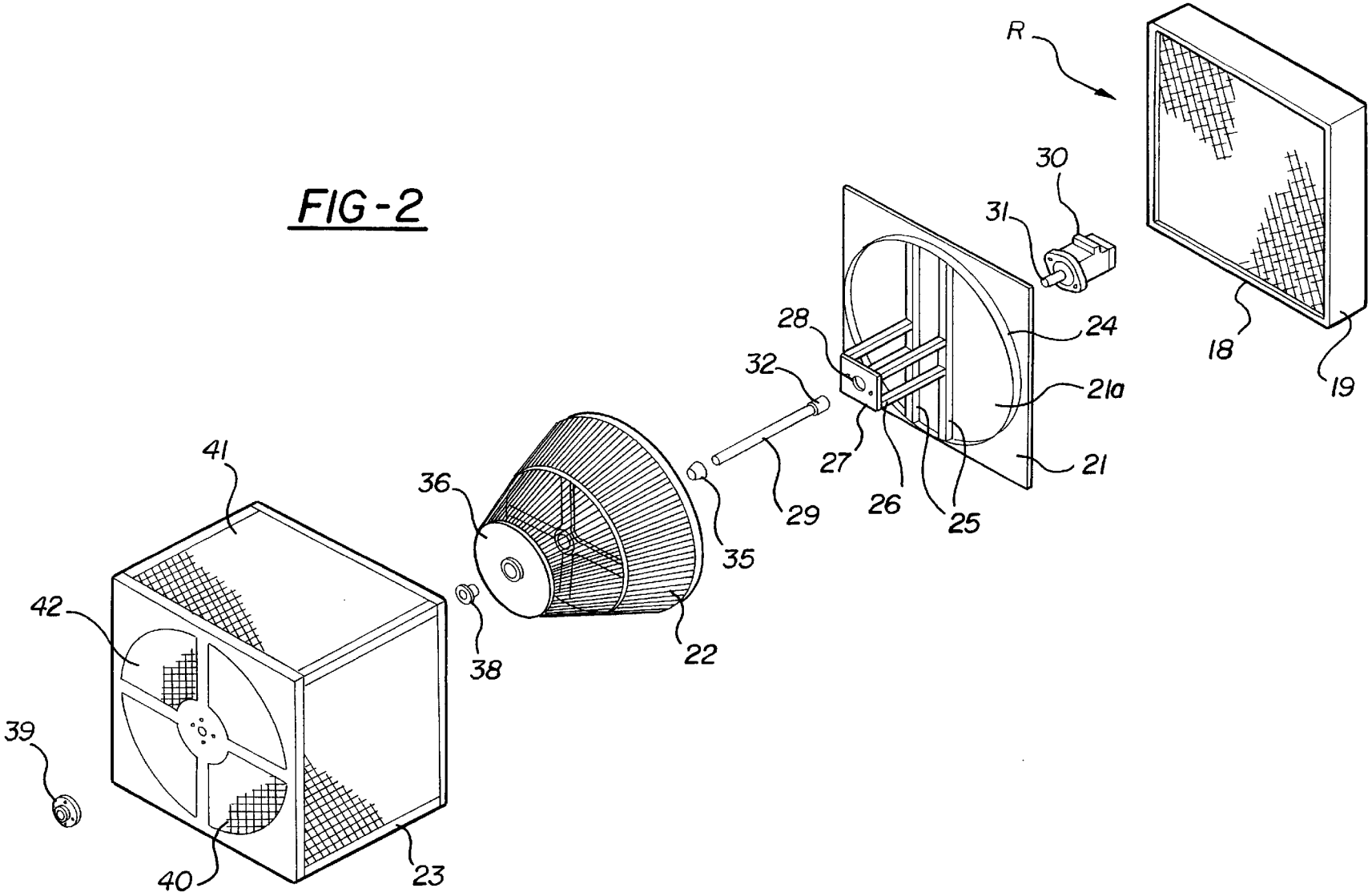
FIG. 2 is a schematic perspective exploded view showing various elements of the overall assembly.

Referring now, more particularly, to the accompanying drawings and, in the first instance particularly to FIGS. 1 and 2, an engine, generally shown at E, has a fan drive shaft 10 shown as operating a belt 11 on a suitable sheave which drives a sheave 13 on a fan drive shaft 14. The suction fan, generally designated 15, is fixed on the shaft 14. The suction fan 15, as usual, has fan blades 16, secured on a hub 17, for creating a suction to pull air in through a radiator, generally designated R, having the usual radiator fins 18. The intake radiator fins 18, as usual, are fixed within a surrounding housing 19.

Provided to mount on the front face of radiator housing 19 is an air cleaner assembly, generally designated 20, which includes a stationary mount plate 21 and a protective, stationary guard housing 23 for a spinning member 22. The system's mount plate 21 includes a circular opening 21*a* (FIG. 2) surrounded by an outwardly extending circular flange 24. Spanning the opening 21*a* are spaced apart bars 25 for mounting a motor housing or cage, generally designated 26, which incorporates a front plate 27 with an opening 28 for admitting a drive shaft 29. The motor 30, which may be a small hydraulic or other type of motor, has a drive shaft 31, which is provided with a splined connection to a coupling sleeve 32 provided on the rear end of shaft 29. Motor 30 may be serviced by a suitable pump and hydraulic system of conventional and well-known character.

Figure 3:
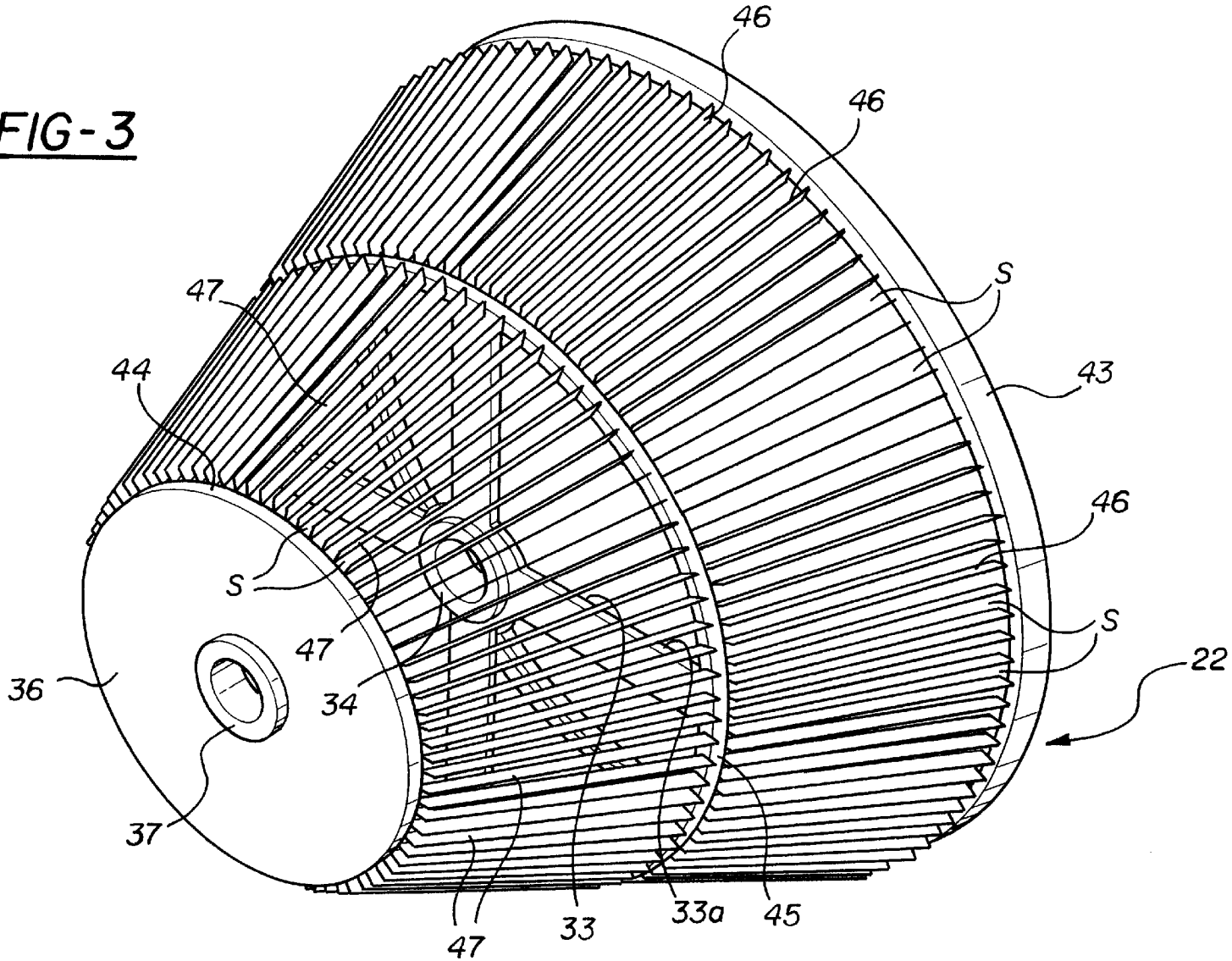
FIG. 3 is a perspective elevational view, more particularly illustrating the conical member which spins on the radiator.

Within the frustro-conical member 22, which mounts within flange 24 and will now be more particularly described, is a shaft mount system, generally designated 33 (FIG. 3), comprising spokes 33a secured to a hub member 34. The hub 34 mounts a shaft drive bushing 35 (FIG. 2) and the end of the conical member 22 is provided with a front plate 36 with a hub ring 37 which receives shaft bushing 38. The conical member drive shaft 29 extends through the bushings 35 and 38 through a bearing 39 received in an opening 40 provided in the front wall of protective guard housing 23. Guard housing 23, which can be mounted to plate 21, may be, as shown, simply provided with top, bottom, and side mesh walls 41 and it will be seen that the front wall also includes a mesh portion 42.

Turning now more particularly and once again to FIG. 3, it will be seen that the conical member or body 22 includes an enlarged open rim rear or inner end band 43 and a reduced diameter open rim outer front end band 44. Received within the rim 44 is the front plate 36, which has a rigid peripheral flange fitting within the member 44. Also, intermediately provided on member 22, is a rigid rim band 45 to provide support for outwardly converging peripherally spaced, relatively thin elongate rigid fins 46 (between rigid bands 43 and 45) and 47 (between rigid bands 44 and 45). Typically, fins 46 and 47 will be 0.0598 thousandths of an inch in peripheral width and be uniformly circumferentially spaced apart a distance of three-eighths of an inch (0.375). The typical overall radial extent of inwardly divergent-in-depth fins 46 and 47 will typically be three-eighths of an inch to a quarter of an inch and the fins 46 and 47 will project radially outwardly and inwardly beyond bands 43 and 45, and bands 44 and 45, slightly less than half that much.

It is believed important that the surface area of the conical periphery 22 be related to the surface area of the radiator fin area 18, and it has been found that the cleaner operates efficiently when the peripheral surface area of the cone is generally twice the surface area of the radiator face 18, and the speed of revolution of the member 22 is controlled with respect to the surface area of the cone. Speeds of rotation in the range 700–1,100 r.p.m. are believed most efficient. When the mean perimetral speed of the member 44 at intermediate band 45 in terms of feet per minute is approximately the same as the speed of the air stream entering the radiator R, very good results are obtained. The air speed through the radiator as measured by an anometer will not be materially reduced by the presence of the device disclosed.

THE OPERATION

In operation, with the device assembled as shown in FIG. 1, air with entrained particulate material enters the guard housing 20 through the mesh walls 41 or 42 which do not significantly prevent the entry of foreign material. When this air stream with entrained dust and particles reaches the member 22, the truly radial fin blades 46 and 47, which have portions projecting radially inwardly and outwardly, as shown in FIG. 6, to define radially elongate, air entrance slits S between the fin blades 46 and 47, prevent the unwanted particles from entering the virtually open, tubular interior of conical member 22 by deflecting the particles from the air flow. The cleaned air entering the member 22 proceeds through to the radiator in the usual fashion and is sucked through the radiator by the suction fan blades. It is important that the turbulence at members 44, 45 and 43 be minimal and this is achieved by the conical shape of member 22 with its larger inner end journaled adjacent to the radiator. The suction created by the suction fan blades is greatest at the large diameter rim 43 where the surface speed of revolution is greater and has dissipated somewhat at the lesser diameter rim 44 where the surface speed of revolution is reduced. A balance is achieved with a frusto-conical angle of inclination between 15 and 45 degrees when air flow volume into the member 22 through uniform width slits S is substantially the same as air flow volume through a radiator with no unit 22 attached. The air flow through the radiator with the unit in place and without it, is checked in this regard.

In a prototype unit, when the overall surface area of the conical member 22, including both the width of the fins 46 and 47 and the gaps or slits S between the fins 46 and 47 was a thousand inches squared and the radiator surface area, including fins 18 and gaps, was 506 inches squared, the speed of air flow through the radiator R, both with the unit attached and without the unit, was 2,200 feet per minute, and with the unit 22 being driven at 700 rpm's, excellent cleaning results were achieved. In this example, the rim speed at member 44 was 2,200 feet per minute and the rim speed at member 43 was 4,600 feet per minute. The frusto-conical angle was 22° and the large diameter and reduced end diameters were 25 and 12 inches, respectively. When the unit was driven at 800 rpm's, the rim speed at member 44 was 1,885 feet per minute and the rim speed at the band 43 was 3,942 feet per minute. The cleaning result when the unit was driven at 600 rpm's was not as good, but at 800–1,100 rpm's was very good in the sense that little difference from 700 rpm's, in terms of cleaning the airstream, was noted.

The goal of providing the attachment unit in the combination of elements was accomplished by deflecting particulate matter from entering the radiator without reducing the air flow to and through the radiator. For example, with sawdust, close to 100 percent has been eliminated from the air stream.

METHOD OF CONSTRUCTION

Figure 4:
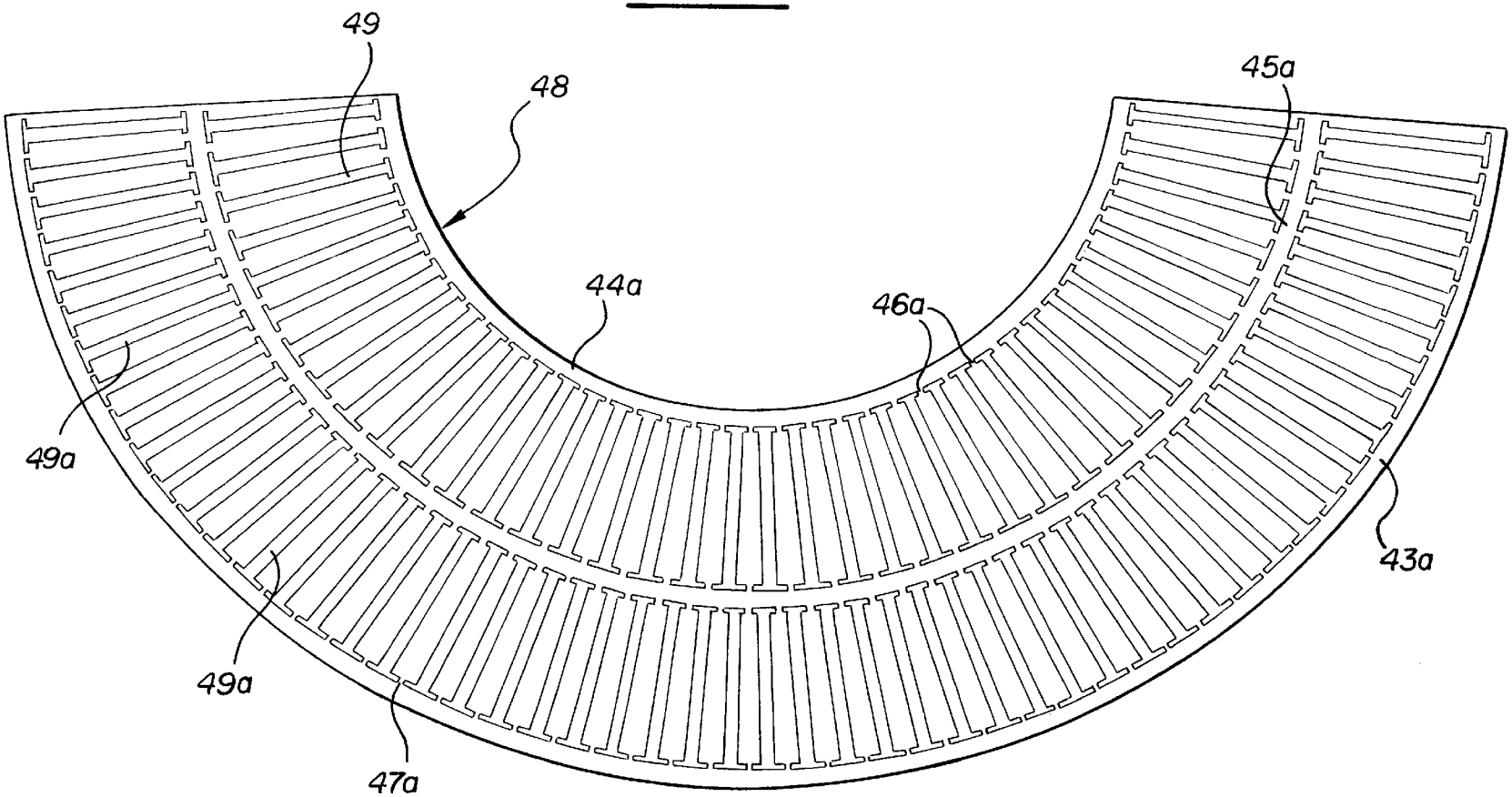
FIG. 4 is a top plan view illustrating a punched strip used in the construction of the conical member.

In FIG. 4, a relatively thin strip of flat sheet metal 48 is shown as in its configuration prior to being bent to frusto-conical shape and welded or otherwise fixed at its ends to form member 22. As shown in FIG. 4, a series of I-shaped uniform width openings 49 and 49*a* are punched in the flat sheet 48 between portions 44*a*, 45*a*, and 43*a*, which will form the peripheral bands 44, 45 and 43.

FIG. 6 shows the fins 46 and 47 formed when the reduced width somewhat ductile end portions 46*a* and 47*a* of the material remaining between openings 49 and 49*a* are twisted ninety degrees to form the radially projecting, inwardly diverging-in-depth, fins 46 and 47. Thereafter, of course, the strip 48 is bent to tubular shape and the ends fixed (i.e., welded) together to form the outer periphery of the member 22, and the plate 36 is assembled in place and fixed. The bushings 35 and 36 are provided for the shaft 29 and the shaft 29 is connected to motor 30 and extended to bearing 40 in the guard housing 23, after which the entire unit, utilizing mount plate 21 can be mounted to the radiator frame 19.

Figures 7, 8:
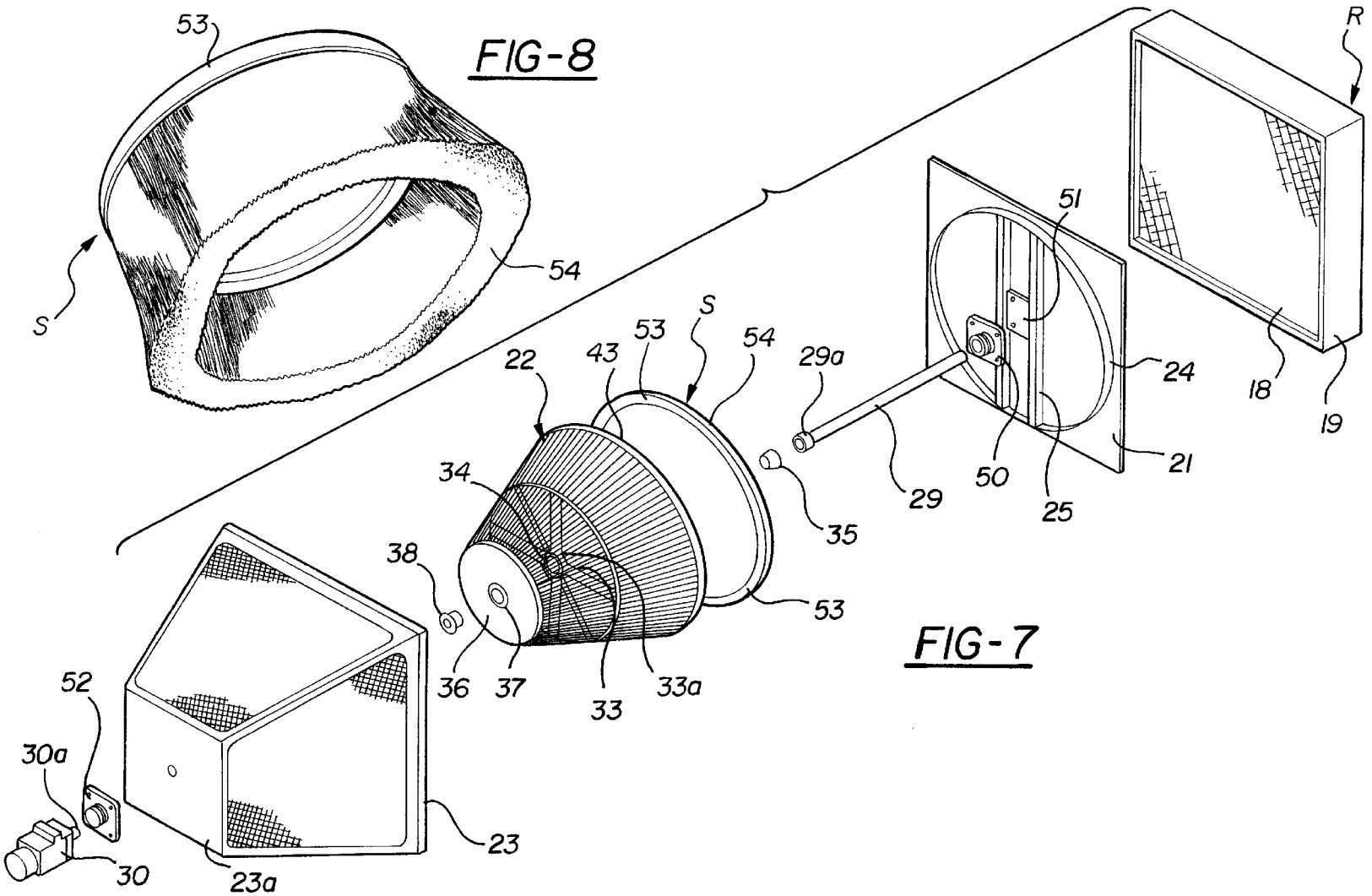
FIG. 7 is a schematic perspective exploded view showing various elements of another embodiment.
FIG. 8 is an enlarged schematic perspective view of a seal member which is employed.

In FIGS. 7 and 8, we have shown a modified form of the invention in which the same numerals and letters have been used to describe the various common parts of the mechanism for the sake of convenience.

One of the differences is that the hydraulic motor 30 is mounted on the front or outer end of the device, on the stationery guard housing 23. Accordingly, the former cage 26, which mounted to the plate 21 on bars 25, is eliminated, and a bearing plate 50 removably fixes to the plate 51 carried by the plate 21 to carry the inner end of shaft 29.

The shaft mount system 33, which similarly has spokes 33*a* carrying hub member 34, is provided on the body member 22 and receives the drive bushing 35. The frusto-conical member 22 is provided with a front plate 36 which receives shaft bushing 38 in hub ring 37 and the end 29*a* of shaft 29 passes through a bearing plate 52 and couples to the motor shaft 30*a*. With the motor 30 supported on the back wall 23*a* of the housing 23, the task of connecting hoses for carrying hydraulic fluid to and from the motor 30 is simplified.

Whereas previously the band 44 of spinning member 22 rotated directly on the flange 24 of plate 21, in the new version a commercially available cup seal (FIG. 8), generally designated CS, is fixed within inner band 43. The seal CS includes a ring 53 which is received on the flange 24 and has a thick metal brush 54, comprising fine flexible metal fibers, engaging the plate 21. It has been found that the efficiency of the unit is increased with the seal CS in place to prevent air, which has entered the spinning member 22 and is flowing to the radiator fins 18, from escaping at the periphery of the unit 22 past rim 43.

The prototype unit constructed according to FIGS. 7 and 8 was larger in diameter and operated successfully. The new member 22 had a diameter of 43 ½ inches at band 43, a diameter of 25 inches at band 44, and a diameter of 34 inches at band 45. The spacing between fins was maintained at ⅜ of an inch and the unit was run at a speed of 1,100 rpm.

It is to be understood that the disclosed embodiment is representative of a presently preferred form of the invention and that others that accomplish the same function are incorporated herein within the scope of the patent claims.

We claim:

1. In combination with an air cooled internal combustion engine having a radiator intake including an engine driven rotary suction fan shaft and fan blades thereon, and an intake radiator housing in front of said fan and having a front ingress and a rear exit, said ingress permitting flow of an air stream through said radiator housing under the influence of said suction fan, the improvement which comprises:

a. a generally frustoconical body having an enlarged diameter inner end mounted adjacent said radiator housing in alignment with said ingress, and also having a reduced diameter outer end;

b. a generally frustoconical body mount part on which said body is mounted for rotation about an axis;

c. said body being made up of substantially axially extending deflector fins extending outwardly in convergent relationship and spaced peripherally apart to provide elongate air entrance slits between them; and d. mechanism for driving said body in rotation to deflect particles seeking to enter said slits away from said slits without materially decreasing the rate of air flow created by said suction fan.

2. The improvement of claim 1 wherein said fins are radially disposed so as not to operate as flow suction members or air stream impedance members.

3. The improvement of claim 1 wherein the peripheral surface area of said body is approximately twice the surface area of said radiator housing ingress.

4. The improvement of claim 1 wherein the frustoconical angle of inclination is between 15 and 45 degrees off axis.

5. The improvement of claim 1 wherein the speed of revolution of the body is in the range of 700–1,100 r.p.m.

6. The improvement of claim 5 wherein a separate rotary hydraulic motor is supported to drive said body in rotation.

7. The improvement of claim 5 wherein said body has an outer end member and is protected by a coarse-screened guard housing supported with said radiator housing, and said motor is mounted on the outer end of said guard housing and has a motor shaft drivably connecting to said body end member.

8. The improvement of claim 1 wherein said ingress includes a plate with a circular inlet opening having an outwardly extending peripheral bearing flange and said body includes an inner peripheral band from which said fins converge outwardly and which surrounds said plate peripheral bearing flange to rotate thereon.

9. The improvement of claim 8 wherein a seal member comprising a cup ring with an annular brush thereon projecting axially is sealably mounted so that said brush engages and helps seal said body band, said plate mounts an axially extending shaft, said body has a perimetral band intermediate its ends with interior generally radially extending internal spokes supporting a coupling received on said motor shaft, and said fins have radial portions projecting outwardly of said bands.

10. The improvement of claim 1 wherein the mechanism for driving said body revolves it at a peripheral rim speed in the range of 1,885 feet/minute to 2,200 feet/minute.

11. The improvement of claim 1 wherein said fins are radially disposed so as not to operate as flow suction members or air stream impedance members, the frustoconical angle of inclination of said fins is between 15 and 45 degrees off axis, a plate with a circular inlet opening for channeling air flow to said radiator has an outwardly extending peripheral bearing flange, said body including an inner peripheral band from which said fins converge outwardly and which rotates on said plate peripheral bearing flange, said plate mounting an axially extending shaft, and said body having end perimetral bands and a perimetral band intermediate its ends with interior radial spokes supporting a coupling received on said motor shaft, said fins projecting outwardly radially beyond said bands to deflect particles.

12. A method of preventing particles from wood grinding and other machines which must operate in particle laden atmospheres from entering the radiator cooling the engine of one of said machines wherein air flow through said radiator from front to rear is induced by a suction fan behind said radiator, comprising:

a. providing a frustoconical hollow body member made up of fins extending outwardly from said radiator in outwardly converging relationship and providing closely peripherally spaced outwardly converging air entrance slits between said fins;

b. mounting said body member adjacent the outer face of said radiator to provide an air flow channel through said body to said radiator; and c. revolving said body at a speed whereby said fins deflect particles seeking to enter said body while permitting the entrance of air through said slits and providing a suction fan induced air flow proceeding to said radiator without materially decreasing the air flow induced by said suction fan for drawing air through said radiator.

13. The method of claim 12 wherein said fins are uniformly spaced apart a dimension in the range of ⅛ inch to ¾ inches.

14. The method of claim 13 in which said fins are spaced apart at a dimension of substantially ⅜ inches.

15. The method of claim 13 wherein said fins are inwardly divergent in radial depth and have an average radial depth corresponding substantially to the width dimension of said slits.

16. The method of claim 12 wherein said body is rotated at a speed in the range of 700–1,100 r.p.m.

17. The method of claim 16 wherein the average perimetral speed of the body is in the range 2,100 to 2,200 feet per minute.

18. For use with an air cooled internal combustion engine having a radiator intake including an engine driven rotary suction fan shaft and fan blades thereon, and an intake radiator housing in front of said fan and having a front ingress and a rear exit, said ingress permitting flow of an air stream through said radiator housing under the influence of said suction fan, the combination which comprises:

a. a generally frustoconical hollow body having an enlarged diameter inner end for mounting adjacent said radiator housing in axial alignment with said fan shaft and said ingress, and also having a reduced diameter outer end;

b. a generally frustoconical body mount part on which said body is mounted for rotation about an axis;

c. said body having generally axially extending deflector fins extending inwardly in divergent relationship and spaced peripherally apart to provide elongate air entrance slits between them; and d. mechanism for driving said body in rotation at a speed which deflects particles seeking to enter said slits without materially decreasing the rate of air flow created by said suction fan.

19. A method of constructing apparatus preventing particles from wood grinding and other machines which must operate in particle laden atmospheres from entering the radiator cooling the engines of said machines wherein air flow through said radiator from front face to rear is induced by a suction fan behind said radiator, comprising:

a. providing a frustoconical hollow body member made up of fins extending outwardly from said radiators in converging relationship and providing closely peripherally spaced air entrance slits between them;

b. mounting said body member adjacent the outer face of said radiator to provide an air flow channel through said body to said radiator; and c. providing a motor revolving said body at a speed whereby said fins deflect particles seeking to enter said body while permitting entrance of air through said slits providing a suction fan-induced air flow proceeding to said radiator without materially decreasing the air flow induced by said suction fan for drawing air through said radiator.

20. The method of claim 19 wherein said fins are spaced apart an average dimension in the area of ⅜ of an inch and have an average depth in the area of ⅜ of an inch, said motor is energized to drive said body in the range of 700–1,100 revolutions per minute, and said body is formed by cutting I-shaped slits into a flat arcuate plate segment having matched ends, bending the material between said slits to commonly project perpendicularly to form said fins, bending said segments into curvilinear tubular shape to function as said body, and securing the ends of said segment together.

* * * * *